United States Patent [19]

Membrino

[11] Patent Number: 4,560,068

[45] Date of Patent: Dec. 24, 1985

[54] DOUBLE-POCKET PAD OF BAGS

[76] Inventor: Hercules Membrino, 280 Paoli Pike, Malvern, Pa. 19355

[21] Appl. No.: 688,801

[22] Filed: Jan. 4, 1985

[51] Int. Cl.[4] ..... B65D 30/22; B65D 85/62

[52] U.S. Cl. ..... 206/554; 206/494; 206/526; 206/806; 383/38

[58] Field of Search ..... 206/449, 494, 526, 554, 206/806; 383/38, 87; 150/138, 147; 229/72, 69

[56] References Cited

U.S. PATENT DOCUMENTS

| | | | |
|---|---|---|---|
| 663,202 | 12/1900 | Walter | 229/72 |
| 3,446,260 | 5/1969 | Osher | 150/147 |
| 4,152,851 | 5/1979 | Goldstein | 206/526 |
| 4,305,503 | 12/1981 | Membrino | 206/554 |
| 4,500,000 | 2/1985 | Membrino | 206/554 |

FOREIGN PATENT DOCUMENTS

| | | | |
|---|---|---|---|
| 850483 | 9/1970 | Canada | 206/554 |
| 2408831 | 8/1975 | Fed. Rep. of Germany | 206/554 |
| 2291106 | 6/1976 | France | 206/554 |

*Primary Examiner*—William T. Dixson, Jr.
*Assistant Examiner*—Brenda J. Ehrhardt
*Attorney, Agent, or Firm*—Arthur A. Jacobs

[57] ABSTRACT

A pad of plastic bags comprising a plurality of bag units stacked upon one another, each unit comprising two open-mouthed pockets separated by a selvage portion between the open mouths, the open mouth of one pocket being in the reverse plane from the open mouth of the other pocket whereby when the unit is folded over on the selvage portion the open mouths of both pockets face in the same direction, and transverse score lines in the selvage portion adjacent each open mouth to permit tearing away of each pocket in the unit from the selvage portion, the selvage portions of all the units being connected to form a base portion.

6 Claims, 7 Drawing Figures

FIG. 4
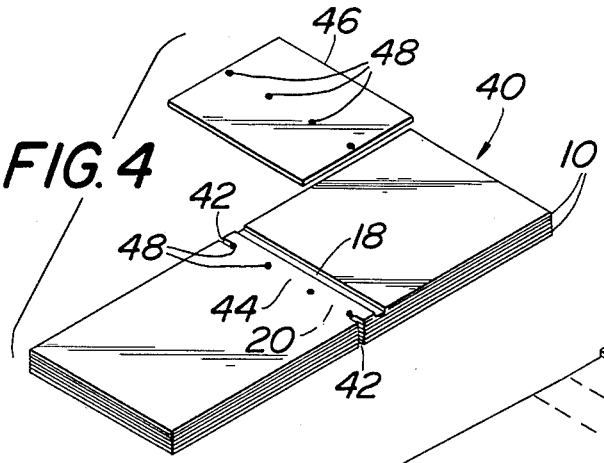
FIG. 6
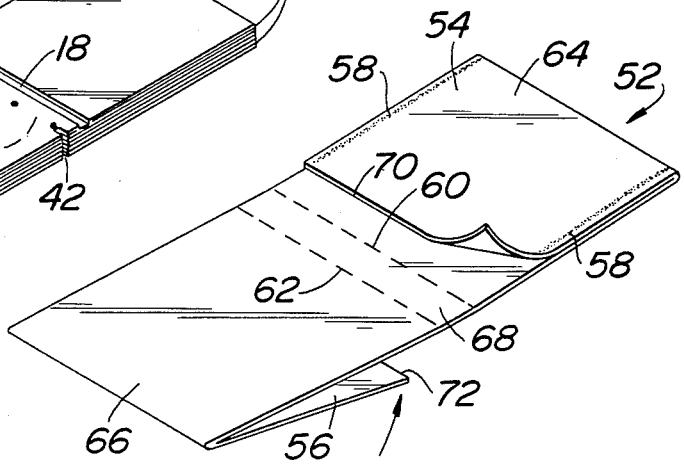
FIG. 5
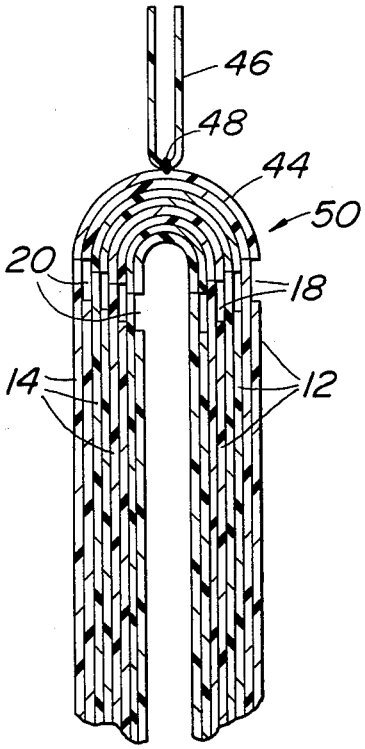
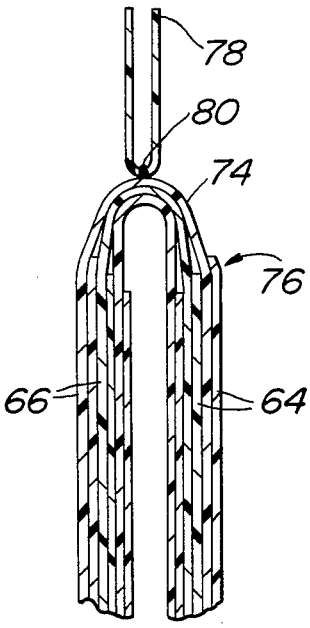
FIG. 7

DOUBLE-POCKET PAD OF BAGS

This invention relates to pads of plastic bags, and it more particularly relates to pads of stacked bag units wherein the bags are completely formed simultaneously with the removal of portions of the units from the pad.

The present invention constitutes an improvement over the pads disclosed in applicant's prior U.S. Pat. No. 4,406,371 wherein the pads comprise a plurality of units, each of which comprises an open-mouthed pocket and a selvage portion, the units being connected to each other by a base portion formed by the selvage portions that extend from the pockets, these selvage portions being connected by common side welds or similar fastening means. These welds not only connect the selvage portions to form the base portion but also constitute anchor means whereby, when a pocket is torn away from the base portion to form a bag, the mouth of the bag is automatically opened by the pulling action because of the counterforce exerted at each side by the welds. Each pocket is separated from its respective selvage portion by a transverse score line in the selvage portion above the open mouth of the pocket.

Although the above-described pads, as disclosed in U.S. Pat. No. 4,406,371, are generally very satisfactory, there are some shortcomings. For example, the pad is made up of single bag units which requires a separate construction for each unit. This separate construction not only requires undue time and labor in the construction of the units but also in their assembly into a pad.

It was heretofore known to avoid such separate bag construction by making double-pocket bag units, as, for example, described in applicant's prior U.S. Pat. Nos. 3,353,661 and 4,305,503. However, these double-pocket bag units required either a central support over which the pad was draped so that bags could be removed from opposite sides of the support, or, if no central support was used, after the bags were removed from one side, the pad had to be turned around so that the bags could be removed from the other side. This was because the mouths of the bags lay in the same horizontal plane when the units were flat and in reverse positions when the pads were folded over on their base portions.

This reverse orientation of the two halves of the pad also interfered with its utilization in a dispensing box having a front opening because only one half of the pad would be available through the box opening unless the pad were physically removed from the box and reversed after one half was used up. On the other hand, if boxes with oppositely-disposed openings were used, it makes the construction of the box both more complicated and more expensive, while simulataneously weakening the box.

It is, therefore, an object of the present invention to overcome the above disadvantages by providing a pad of plastic bags which can be constructed with less expenditure of time and labor than was heretofore possible.

Another object of the present invention is to provide a pad of plastic bags of the above type which is made up of a stack of double-pocket units wherein the pockets are so oriented that their open mouths all face in the same direction when they are folded over on the base portion.

Another object of the present invention is to provide a pad of plastic bags of the aforesaid type which does not require a separate central support over which to drape the pad but which can be utilized while held in the hands or dispensed from a box or similar container having a single opening.

Other objects and many of the attendant advantages of this invention will be readily appreciated as the same becomes better understood by reference to the following description when read in conjunction with the accompanying drawings wherein:

FIG. 4 is a top perspective view of a stack of the double-pocket bag units in flat condition.

FIG. 5 is a sectional view of the stack of FIG. 4 folded over to form the pad.

FIG. 6 is a partially exploded, top perspective view of a double-pocket bag unit similar to that of FIGS. 1–3 but of modified construction.

FIG. 7 is a sectional view of a stack of bag units of the type shown in FIG. 6 which have been folded over to form a pad.

Figure 1:
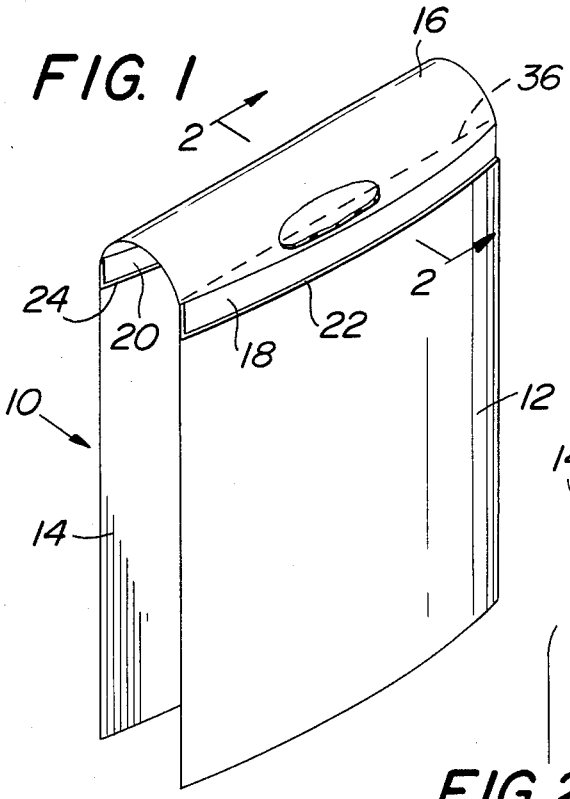
FIG. 1 is a front perspective view, partly broken away, of a double-pocket bag unit embodying the present invention.

Referring in greater detail to the drawings wherein similar reference characters refer to similar parts, there is shown in FIG. 1 a double-pocket plastic bag unit, generally designated 10, comprising a front pocket 12, a rear pocket 14 and a selvage portion 16 between and integral with both said pockets. Each pocket 12 and 14 has an open mouth, as at 18 and 20 respectively, said mouths having respective lips 22 and 24.

Figure 2:
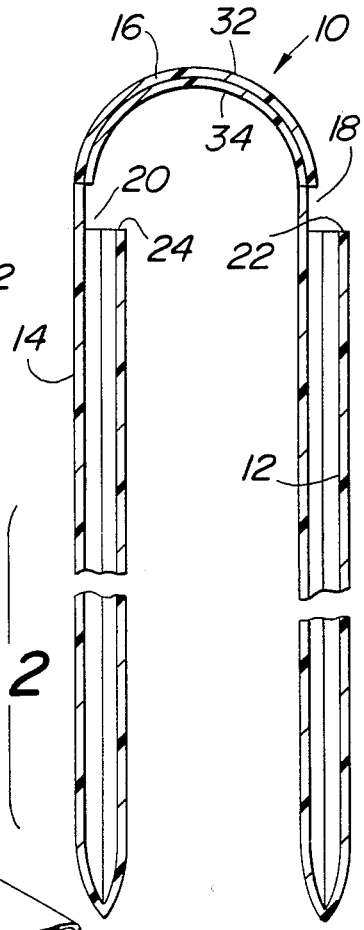
FIG. 2 is a sectional view taken on line 2—2 of FIG. 1.

It should be noted that the mouths 18 and 20 face in the same direction when the unit is folded over, as in FIG. 2. This means that when the unit is flat, the mouth 18 faces upwardly while the mouth 20 faces downwardly. This is the reverse type of construction from that heretofore used for double-pocket bag units as, for example, disclosed in the aforementioned prior patents. This construction permits the formation of two bag pockets from a single unit, while yet permitting the units to be folded over so that both pockets may be filled and/or torn away from the base portion in the same direction.

Figure 3:
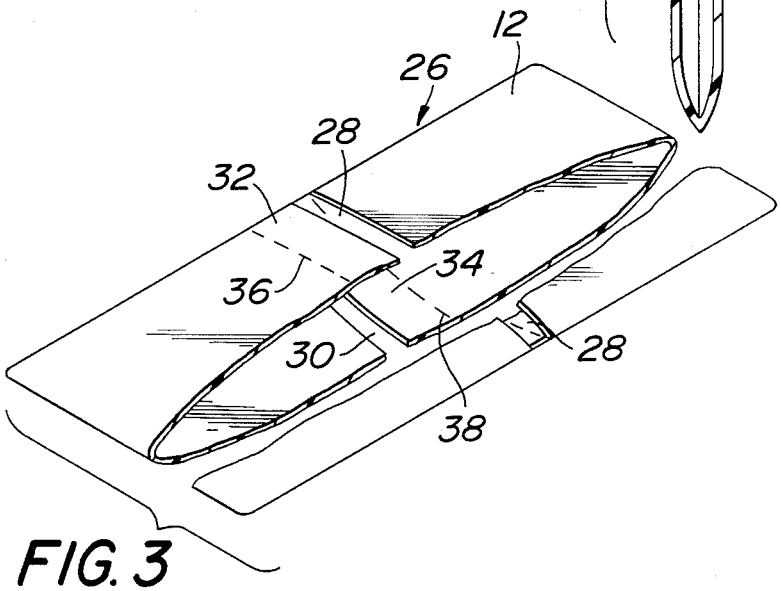
FIG. 3 is a fragmentary perspective view showing the method of construction of the unit of FIGS. 1 and 2.

FIG. 3 shows the formation of a bag unit, such as shown in FIGS. 1 and 2, by utilizing a tubular section of plastic material. The tube, indicated at 26, is slotted in its upper surface, as at 28, and in its lower surface, as at 30. The slots 28 and 30 are offset from each other in the horizontal plane, as viewed in FIG. 3, whereby the area in the upper surface between the slot 28 and the plane of the slot 30 constitutes one wall 32 of the selvage portion 16 while the area in the lower surface between the slot 30 and the plane of the slot 28 constitutes another wall 34 of the selvage portion 16. Score lines 36 and 38 represent the tear lines for the respective pockets 12 and 14.

FIG. 4 shows a stack, generally designated 40, of the units 10. The stack, when in this flat position, has each unit with one mouth 18 uppermost and one mouth 20 underneath. The selvage portions of the units are welded together at the sides, as shown at 42, to form the base portion 44. Although welds are preferred, other feasible fastening means may be substituted.

In order to provide a handle for the stack, a sheet of plastic 46 is welded to the base portion, the welds being formed at a center line of the sheet 46 and at the center of the base portion, as shown at 48, whereby the sheet may be folded over and the two free ends, or flaps, of the sheet may be grasped as a handle. This is best shown in FIG. 5 where the stack is shown folded over on the base portion 44 to form the pad, generally designated 50, and the sheet 46 is folded over to form the handle.

Although the tubular material, as shown in FIG. 3, is preferred, especially when the plastic film used is very light weight or flimsy, since it is not only easier to handle but also provides double thickness at the selvage portions, it is possible, especially when relatively heavy gauge plastic material is used, to use sheet material. This is shown in FIG. 6 where a unit, generally designated 52, comprises a sheet of relatively heavy gauge plastic which is folded into a substantial S-shape with one flap 54 overlying the front surface and a second flap 56 underlying the rear surface, these flaps being at opposite ends of the sheet. The sides of the flaps are then welded or otherwise sealed, as shown at 58, and a pair of spaced parallel score lines are provided, as at 60 and 62, to separate the resultant pockets 64 and 66 from the selvage portion 68. The overlapped edges 70 and 72 form the lips of the open mouths of the respective pockets 64 and 66.

When the units 52 are stacked together and the selvage portions are welded or otherwise connected at the sides, in a manner similar to that shown in FIG. 4, to form the base portion, indicated at 74 in FIG. 7, there is formed a pad, generally designated 76. A sheet 78, similar to that shown at 46, is welded at its center to the base portion 74, as at 80, and folded over to provide a handle.

The above described construction permits the pad to be used without a rigid support such as a wall or stand since the handle 46 or 78 may be grasped in one hand while a bag is grasped and torn away from the base portion with the other hand. However, if it is desired to anchor the pad to a wall or other supporting surface, this can easily be accomplished, as, for example, by providing an aperture in the handle to receive a hook, nail or other hanging device or by providing adhesive or the like to the handle for adhesion to the surface.

The invention claimed is:

1. A pad of plastic bags comprising a plurality of bag units overlying each other, each bag unit comprising a pair of pockets each of which has a front wall, a rear wall and an open mouth, said pockets being linearly spaced from each other by a selvage portion between their respective mouths, said selvage portion being formed by integral extensions of the rear walls of said pockets, and the front walls of said pockets being integral extensions of their respective rear walls, said front walls being spaced at their upper edges from said selvage portion to form the respective mouths, the mouth of one of said pockets being only on the upper surface of said unit and the mouth of the other of said pockets being only on the lower surface of said unit when said unit is laid flat in a horizontal position, the selvage portions of said units being connected to each other to form a base portion, said base portion being overfoldable to form the pad wherein, when overfolded, the mouths of all the pockets in the pad face in the same direction, and spaced parallel lines of weakness in said base portion to permit removal of individual bag-forming pockets from said base portion.

2. The pad of claim 1 wherein said selvage portions are connected to each other at the opposite sides thereof.

3. The pad of claim 1 wherein said selvage portions are connected to each other by welds.

4. The pad of claim 1 wherein a flexible handle is connected to said base portion.

5. The pad of claim 1 wherein each unit is formed from tubular material.

6. The pad of claim 1 wherein each unit is formed from a single sheet overfolded into a substantial S-shape and having the side edges of the resultant pockets sealed, with one edge of each pocket left unsealed to form the open mouth.

* * * * *